US006227911B1

(12) United States Patent
Boutros et al.

(10) Patent No.: US 6,227,911 B1
(45) Date of Patent: May 8, 2001

(54) RJ CONTACT/FILTER MODULES AND MULTIPORT FILTER CONNECTOR UTILIZING SUCH MODULES

(75) Inventors: Kamal Shawiky Boutros, Richmond Hill; Bonita Lynn Rose, Toronto, both of (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/149,567

(22) Filed: Sep. 9, 1998

(51) Int. Cl.[7] ..... H01R 3/00; H01R 13/66
(52) U.S. Cl. ..... 439/620; 439/490
(58) Field of Search ..... 439/620, 107, 439/95, 92, 490

(56) References Cited

U.S. PATENT DOCUMENTS

| | | | | |
|---|---|---|---|---|
| 4,695,115 | | 9/1987 | Talend . | |
| 4,978,317 | | 12/1990 | Pocrass . | |
| 5,015,204 | * | 5/1991 | Sakamoto et al. | 439/620 |
| 5,069,641 | * | 12/1991 | Sakamoto et al. | 439/620 |
| 5,139,442 | * | 8/1992 | Sakamoto et al. | 439/620 |
| 5,397,250 | | 3/1995 | Briones . | |
| 5,403,207 | | 4/1995 | Briones . | |
| 5,531,612 | | 7/1996 | Goodall et al. . | |
| 5,587,884 | | 12/1996 | Raman . | |
| 5,639,267 | | 6/1997 | Loudermilk . | |
| 5,687,233 | | 11/1997 | Loudermilk . | |
| 5,736,910 | | 4/1998 | Townsend et al. . | |
| 5,759,067 | * | 6/1998 | Scheer | 439/620 |
| 5,775,946 | | 7/1998 | Briones . | |

* cited by examiner

*Primary Examiner*—Paula Bradley
*Assistant Examiner*—James R. Harvey
(74) *Attorney, Agent, or Firm*—Blank Rome Comisky & McCauley, LLP

(57) ABSTRACT

An RJ contact module includes a plurality of RJ contacts, a plurality of contact tails separate from the RJ contacts, and a plurality of filtering and isolation components. The ends of the RJ contacts that are opposite the mating ends of the contacts, and the ends of the contact tails that extend into the connector, are either formed into vertically extending wire-wrap terminals to which wire leads of the components may be connected, or solderless contact extensions arranged to engage electrodes on chip-type capacitors or electrodes, with additional solderless connections being provided as necessary between the components, and between the components and a shield or ground plate external to the module. The RJ contact module may be inserted into a multiport connector housing including at least two rows of RJ ports isolated by an intermediate shield plate to which components in the modules are connected.

16 Claims, 14 Drawing Sheets

RJ CONTACT/FILTER MODULES AND MULTIPORT FILTER CONNECTOR UTILIZING SUCH MODULES

BACKGROUND OF THE INVENTION

1. Field of the Invention

This invention relates to the field of electrical connectors, and in particular to modules having arranged thereon a plurality of RJ contacts, electrical filtering and isolation components (sometimes referred to for convenience as filter components), and contact tails, the modules being arranged to be inserted into a shielded connector housing. The invention also relates to a multiple port (multiport) filter connector utilizing such modules, although those skilled in the art will appreciate that the modules could also be utilized in a single port connector housing.

The invention makes use of the principle of forming the ends of RJ contacts and contact tails into terminals to which the electrical filter components can easily be wired or otherwise connected as disclosed in copending U.S. patent application Ser. No. 08/866,107, filed May 30, 1997, and may also employ the filtering and isolation structure described in copending U.S. patent application Ser. No. 08/657,209, filed Jun. 3, 1996, both of which are incorporated by reference herein. In addition, aspects of the multiport filter connector of the present invention are disclosed in U.S. Pat. No. 5,531,612 (Goodall et al.), U.S. Pat. No. 5,639,267 (Loudermilk), and U.S. Pat. No. 5,775,946 (Briones), all of which are incorporated by reference herein.

2. Description of Related Art

Electrical connectors known as modular phone receptacles or jacks have been available for many years. Although connectors of this type were originally designed for use in telephone systems, they have found wide acceptance in a variety of other contexts. For example, modular jacks referred to as RJ connectors, which may be incorporated into single port or multiport arrangements, are now commonly used as input/output (I/O) interface connectors for enabling computers to communicate with each other and with a variety of peripheral equipment, and in particular as connectors between a local area network (LAN) and an appropriately configured interface card.

In order to receive a corresponding modular plug, the conventional modular jack or RJ connector is generally made up of a socket housing which includes a plug-receiving opening, opposed top and bottom surfaces joined by opposed side surfaces extending from the opening to a back surface, and a plurality of stamped, metallic elongated contacts mounted in the housing for engaging contacts of the corresponding plug. Each contact in this type of connector includes a contact mating portion at one end extending diagonally into the socket, a vertically extending lead portion at the other end, and a horizontally extending intermediate portion between the contact mating portion and the lead portion. Generally, the lead portions of the contacts are inserted directly into openings in the interface card and soldered in place.

Because the above-described type of modular jack or RJ connector is often used for digital communications, wires and contacts in this type of connector emit high frequency radiation which can interfere with other electrical equipment. In addition, circuitry to which the connector is connected are vulnerable to noise or transients induced in an incoming line by external sources. While adding filtering circuitry to the interface card can often be used to solve such problems, the difficulty of designing circuitry which meets current emissions requirements as well as space considerations suggests that inclusion of filtering or transient suppression capabilities in the connector would be desirable under certain circumstances, and in particular where the cost of providing on-board filtering exceeds the cost of adding filters to the connector.

Historically, attempts to add filtering or isolation components to interface connectors for LANs and similar applications have fallen into one of three categories:

1.) connectors in which the filter components are provided on a miniature circuit board fitted into or onto the connector, as described in U.S. Pat. No. 5,069,641 (Sakamoto et al.), or on circuit board traces applied directly to the connector, as described in U.S. Pat. No. 5,282,759 (Sakamoto et al.);

2.) connectors in which the connector contacts are inserted through central openings in a ferrite block which forms the inductive component of the common mode filter, as described in U.S. Pat. No. 4,772,224 (Briones) and U.S. Pat. No. 5,397,250 (Talend); and 3.) connectors in which the contacts are wrapped around the filter components, as described in U.S. Pat. No. 5,015,204 (Sakamoto et al.) and U.S. Pat. No. 5,139,442 (Sakamoto et al.).

Filters of the first type, in which the circuitry is provided on a printed circuit board, have the disadvantage that they are relatively expensive in comparison with corresponding circuitry mounted on a host interface card or circuit board, due to the limited space available within the standard connector and the consequent need for miniaturization. Filters of the second and third types, on the other hand, are simpler to install and use less expensive components, but have the disadvantage of failing to offer electrical isolation between input and output circuits, as a result of which the isolation circuitry must still be provided on the host circuit card.

More recently, techniques have been developed for including both "filtering" and isolation components within RJ connectors without the need for internal circuit boards while at the same reducing the number and complexity of assembly steps. Copending U.S. patent application Ser. No. 08/866,107, for example, discloses an arrangement for including within the connector both a common mode filter and an isolating transformer. In this arrangement, the mating portion of the contact structure is separated from the terminals or PCB tails extending from the connector to form the connection to circuits on the card on which the connector is mounted, and the components are arranged on a module and connected to the contacts by wire wrapping the leads of the components to ends of the contacts that have been formed into terminals.

The arrangement disclosed in copending U.S. patent application Ser. No. 08/866,107 greatly simplifies assembly of the connector, while increasing design flexibility because the terminal pattern and interconnections between the terminals can easily be varied without varying the housing footprint or the component mounting arrangement.

The present invention extends this concept still further by applying it to modules suitable for use in stacked or multiport RJ type connectors (although the modules can also be used in single port connectors), and by including on the modules various filter components in addition to the inductive or magnetic components described in U.S. patent application Ser. No. 08/866,107.

Multiport RJ type connectors are well-known, including modular versions in which the RJ contacts are arranged on modules that can be inserted into the RJ connector housing.

U.S. Pat. Nos. 5,639,267 and 5,531,612 show typical examples of such connectors. However, none of the prior multiport connectors that utilize a modular design provides for inclusion of filter components on the modules, and none of the prior RJ component mounting arrangements, except for that of copending U.S. patent application Ser. No. 08/866,107 appears to be suitable for use in a multiport connector, where space is even more limited than is the case with a single port connector.

The modular RJ filter connector arrangement disclosed in U.S. Pat. No. 5,587,884 (Raman), for example, requires that the electrical filter and isolation components be mounted on a circuit board that is potted into the connector, and that is separate from the module to which the contacts are secured. Similarly, the arrangement disclosed in U.S. Pat. No. 5,687,233 requires a separate RJ contact module and isolation/filter component module. Such separate mounting of components would be difficult to achieve in a multiport connector.

In addition, even though these prior filtering and isolation arrangement provide for the inclusion of capacitors or other components in addition to inductors and transformers, the components are generally soldered to the circuit boards or modules to which they are mounted, which causes difficulties in the case of modules arranged to fit within a standard multiport RJ connector footprint. While solderless filtering arrangements for RJ connectors are also known, for example from U.S. Pat. No. 4,695,115 (Talend) and U.S. Pat. No. 5,387,250 (Briones), such arrangements are not suitable for use in filter modules of the type disclosed in the above-cited U.S. Pat. Nos. 5,587,584 and 5,687,233. Other prior isolation and/or filtering arrangements for RJ or similar connectors that have even less applicability to RJ contact modules or multiport filter connectors, are disclosed in U.S. Pat. Nos. 5,403,207 (Briones) and U.S. Pat. No. 5,736,910 (Townsend et al.).

Finally, the inclusion of LEDs in RJ filter connectors is known from a number of prior patents, including U.S. Pat. No. 4,987,317 (Pocrass), but it appears that no attempt has previously been made to include such LEDs in modular multiport connectors of the type described above.

SUMMARY OF THE INVENTION

It is accordingly a first objective of the invention to provide an RJ contact module that includes a plurality of electrical isolation and filter components, and yet that is suitable for use in a multiport filter connector as well as in a single port filter connector.

It is a second objective of the invention to provide a multiport filter connector in which the contacts are provided on modules that also include isolation and filter components, and yet which can be easily assembled and that fits within a standard multiport connector footprint.

It is a third objective of the invention to provide a contact/filter module for an RJ connector that includes not only magnetic components, but also capacitors and/or resistors, and yet that can be easily assembled and that permits a wide variety of circuit design variations.

It is a fourth objective of the invention to provide an RJ contact module that includes magnetic components and additional electrical components such as capacitors and/or resistors, at least one of the additional components being connected to ground via a solderless connection upon insertion of the module into a connector, and the remaining additional electrical components being assembled to the connector and electrically connected to the RJ contacts, magnetic components, and/or contact tails by solderless connections.

It is a fifth objective of the invention to provide a multiport filter connector having an improved LED indicator mounting arrangement.

These objectives of the invention are achieved, in accordance with the principles of a preferred embodiment of the invention, by providing an RJ contact module having secured thereto a plurality of RJ contacts, a plurality of contact tails separate from the RJ contacts, and a plurality of filtering and isolation components. The ends of the RJ contacts that are opposite the mating ends of the contacts, and the ends of the contact tails that extend into the connector are either formed into vertically extending wire-wrap terminals to which wire leads of the components may be connected, or solderless contact extensions arranged to engage electrodes on chip-type capacitors or electrodes, with additional solderless connections being provided as necessary between the components, and between the components and a shield or ground plate external to the module.

The objectives of the invention are further achieved by providing a multiport electrical connector which includes a main housing and a plurality of contact modules inserted therein, each module having secured thereto a plurality of RJ contacts, a plurality of contact tails separate from the RJ contacts, and a plurality of filtering and isolation components. The ends of the RJ contacts that are opposite the mating ends of the contacts, and the ends of the contact tails that extend into the connector, are either formed into vertically extending wire-wrap terminals to which wire leads of the components may be connected, or solderless contact extensions arranged to engage electrodes on chip-type capacitors or electrodes, with additional solderless connections being provided as necessary between the components, and between the components and a shield or ground plate within the connector.

The objectives of the invention are further achieved by providing an RJ contact module and a multiport connector having the aforementioned construction and further including sub-modules to which LEDs may be optionally mounted.

Although the preferred embodiments of the invention are directed in particular to RJ type modules and connectors, such as a high speed RJ-45 connector of the type typically used on network or communications interface cards, it will be appreciated by those skilled in the art that the principles of the invention could possibly be used in other types of multiple contact connectors requiring isolating and filtering components.

DETAILED DESCRIPTION OF THE PREFERRED EMBODIMENTS

Figure 1:
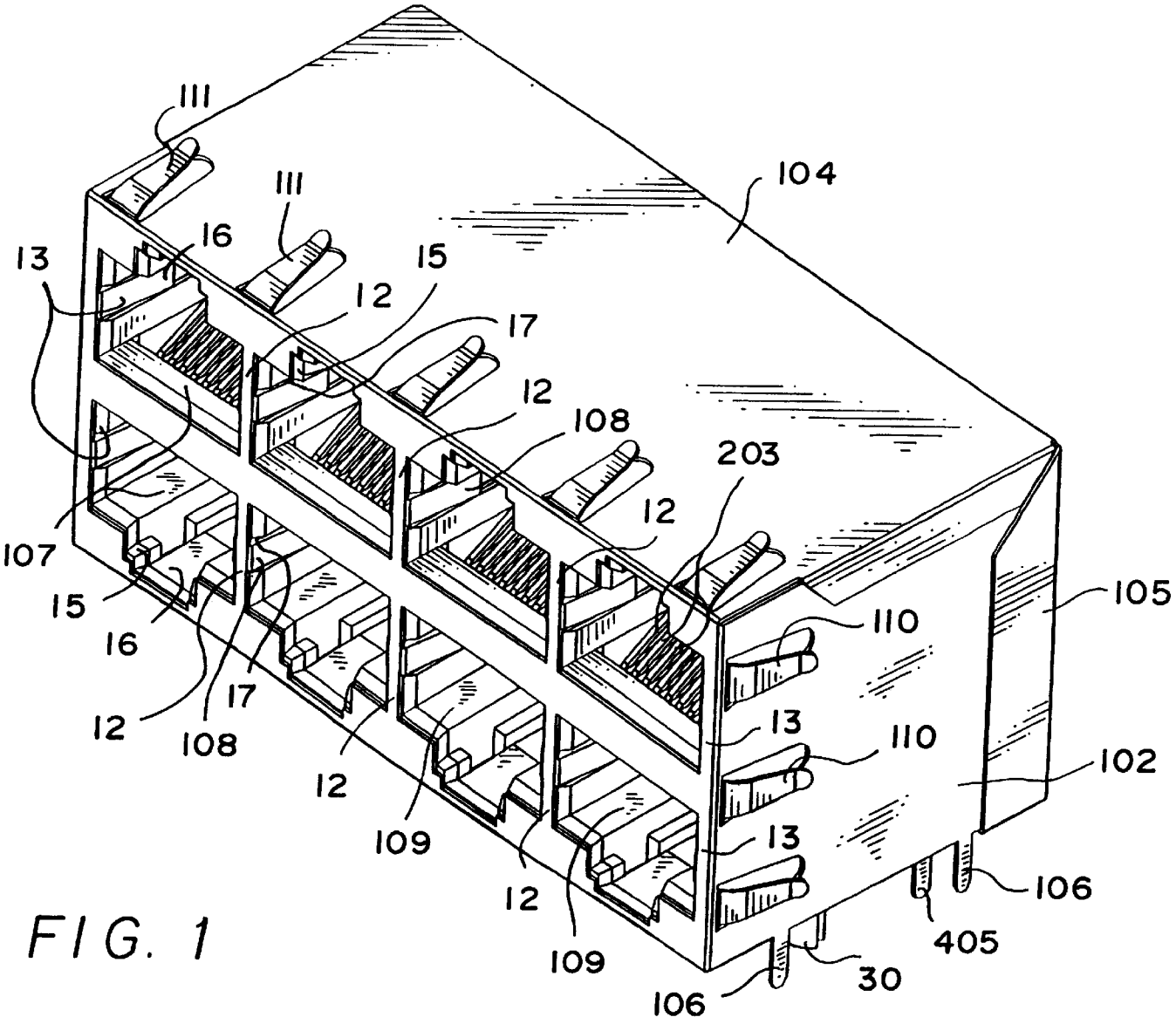
FIG. 1 is an isometric view of a multiport filter connector constructed in accordance with the principles of a first preferred embodiment of the invention.
Figure 2:
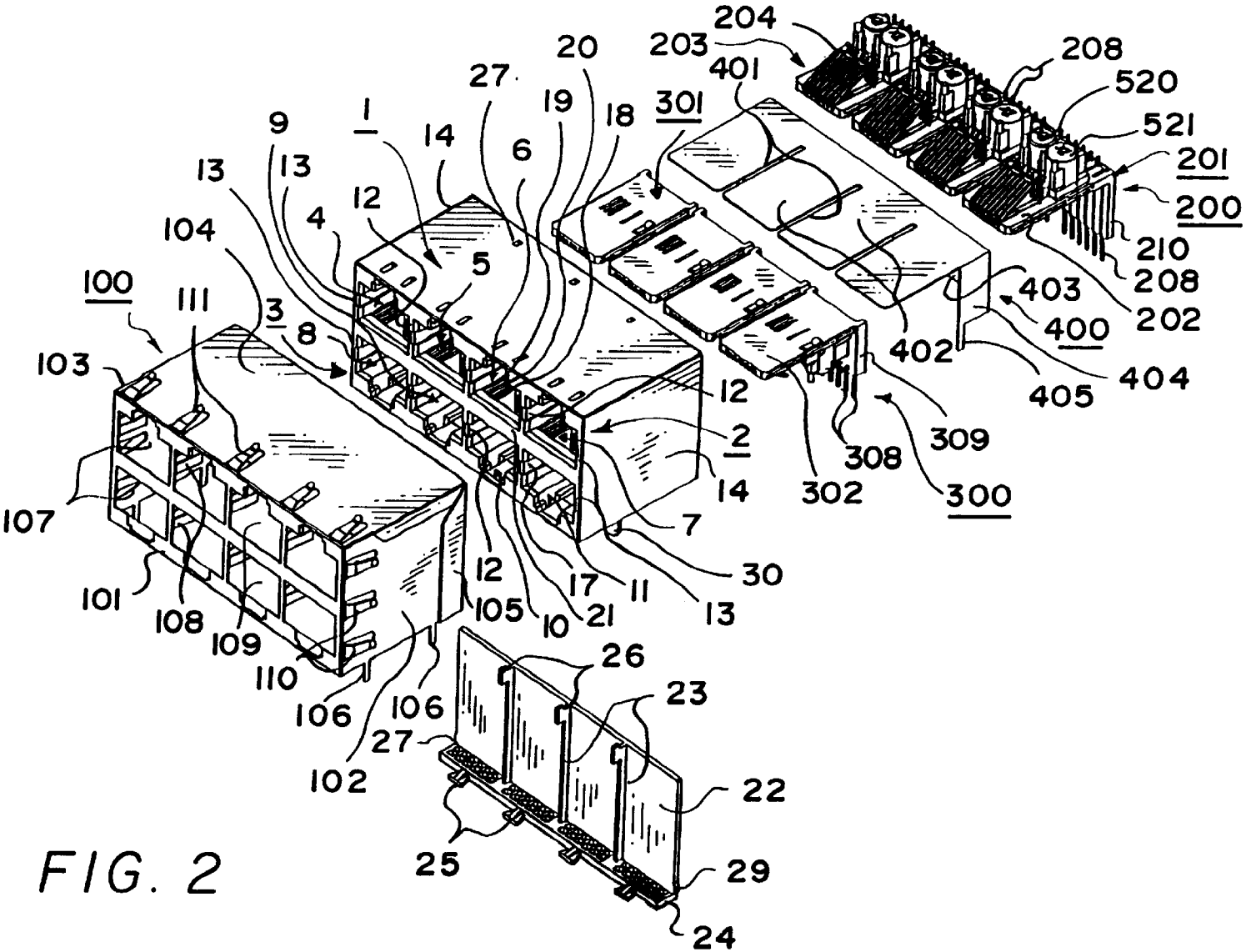
FIG. 2 is an isometric view showing the principal components of the multiport filter connector illustrated in FIG. 1.
Figure 3:
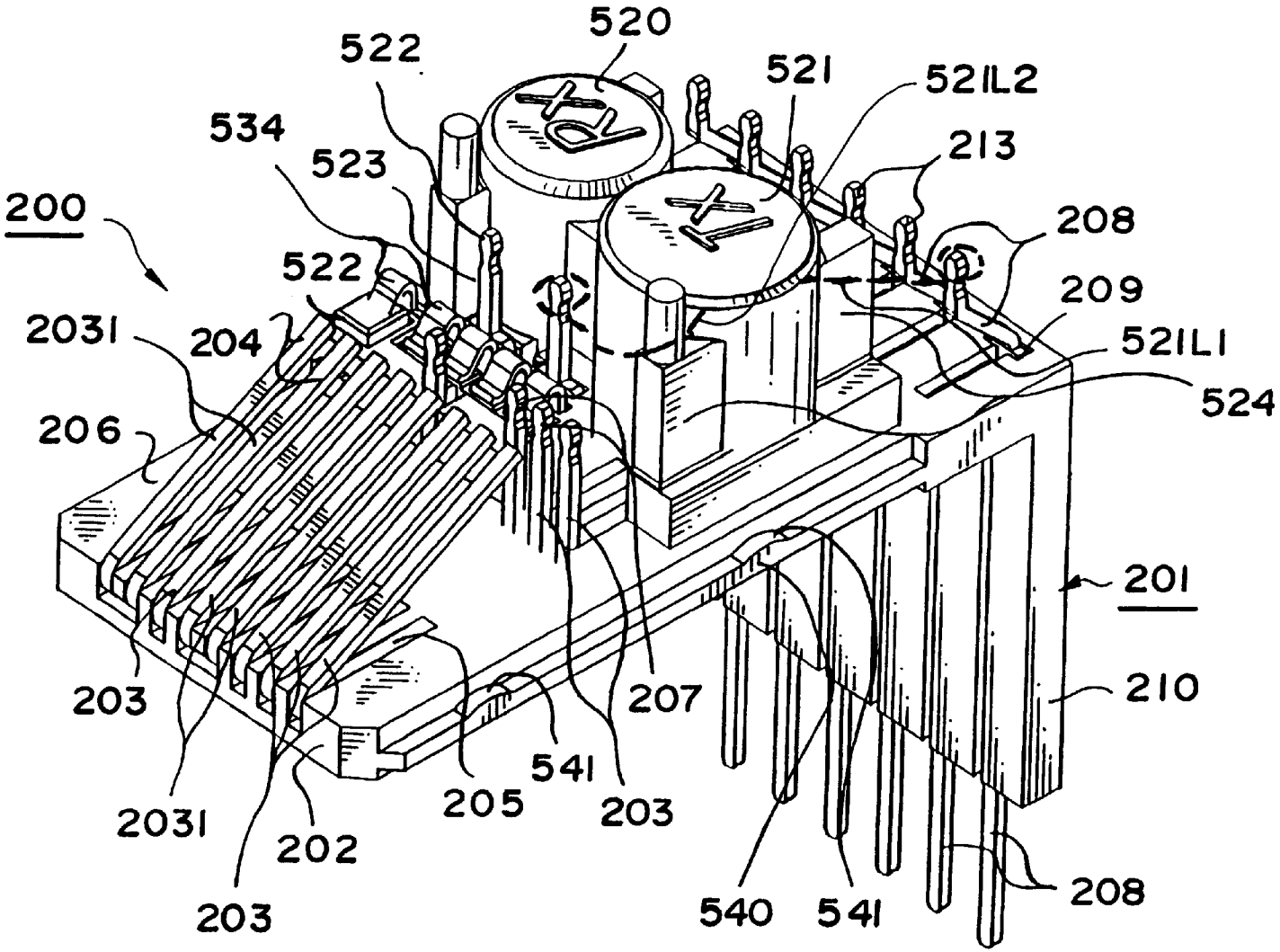
FIG. 3 is an isometric view of a first contact/filter module for use in the multiport filter connector of FIG. 1.
Figure 4:
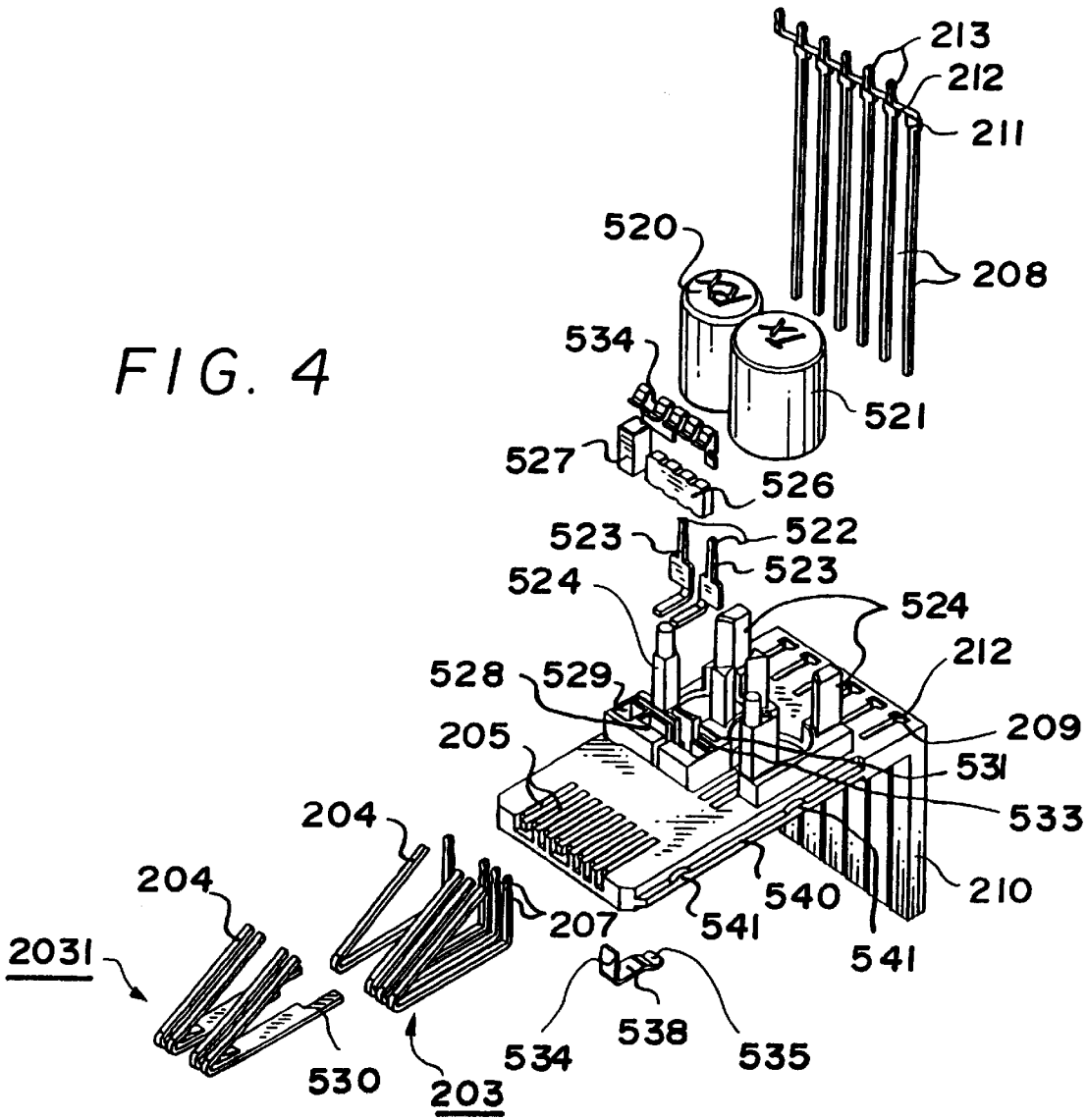
FIG. 4 is an isometric view showing the principal components of the contact/filter module illustrated in FIG. 3.
Figure 5:
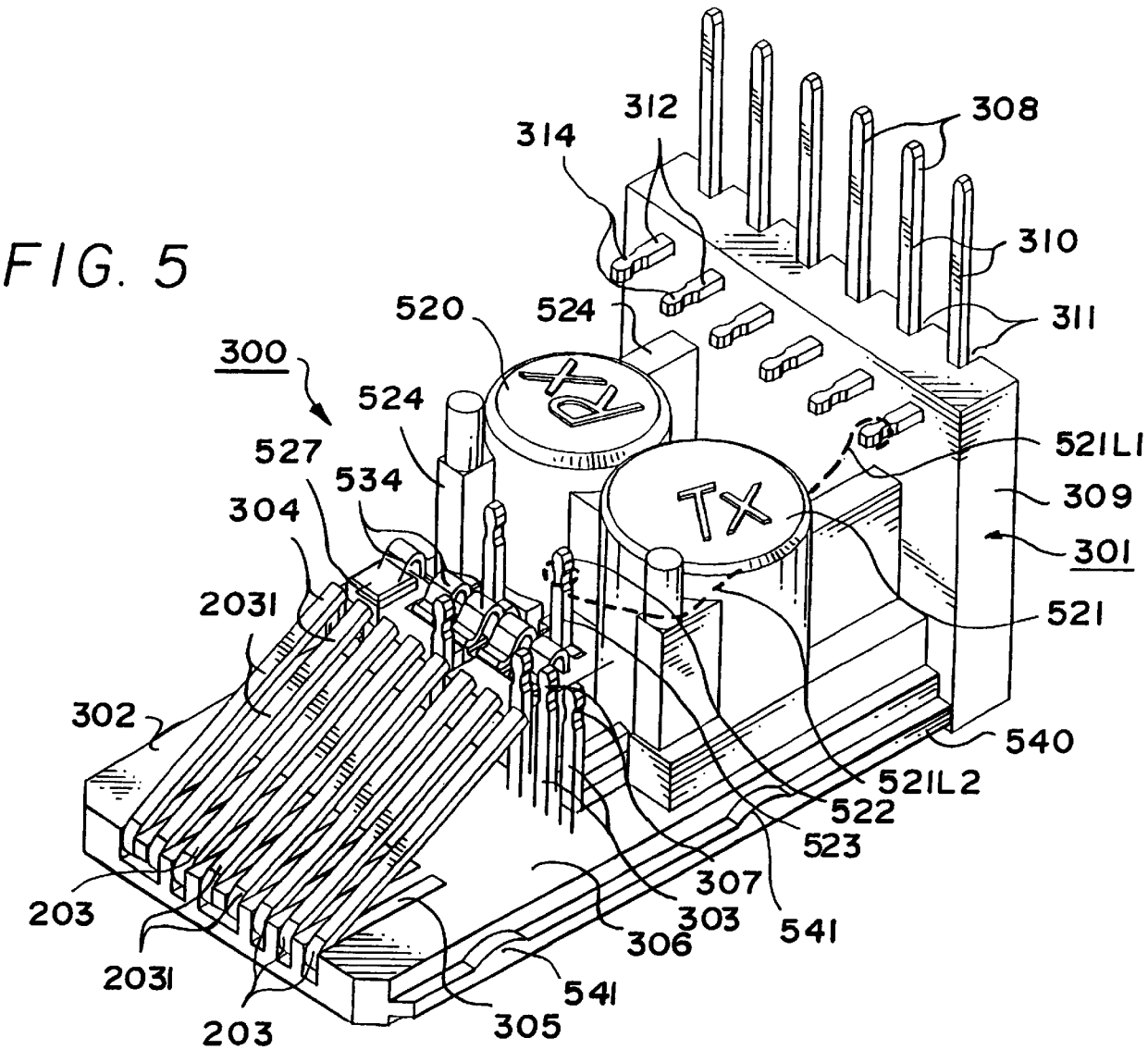
FIG. 5 is an isometric view of a second contact/filter module for use in the multiport filter connector of FIG. 1.

As illustrated in FIGS. 1 and 2, the multiport filter connector of the first preferred embodiment of the invention includes a main dielectric housing 1 having two rows 2 and 3 of respective openings 4–7 and 8–11, each arranged to receive an RJ connector plug, and commonly referred to as ports. Adjacent openings in each row are separated by partition walls 12 which form side walls of the openings, with the outside sidewalls 13 of the outside openings 4, 7, 8, and 11 being defined by the side walls 14 of the main dielectric housing 1. The side walls of the openings include steps 15 for defining notches 16 arranged to receiving latches provided on the standard RJ connector plugs, as is well known. Each of the side walls also includes, between the steps 15, a groove 17 for accommodating a ground tab 108, described below in connection with the outer shield 100, with the portions of partition walls 12 and outside side walls 13 that extend vertically between the horizontal rows 2 and 3 having formed therein three parallel slots 18–20 extending from a horizontal front wall section 21 to the rear of the openings, the slots being open at the rear for receiving, respectively, upper contact modules 200, lower contact modules 300, and intermediate shielding member 400.

Main dielectric housing member 1 is open at the rear but is arranged, in known fashion, to receive a rear wall 22 after insertion of the contact assemblies. The rear wall includes ribs 23 that fit between inserted contact/filter modules, a base portion 24 having openings for permitting passage of respective contacts extending downwardly from the contact/filter modules for insertion into a circuit board on which the connector assembly is to be mounted. Extending inwardly from the base are trapezoidal tabs 25 which engage corresponding openings at the rear of the base of the bottom wall of the housing member (not shown), and extending upwardly from ribs 23 are tabs 26 that fit within openings 27 in the top wall 28 of the main dielectric member 1, tabs 25 and 26 cooperating to help hold the rear wall 22 to the dielectric housing 1 upon assembly of the rear wall to the housing after insertion of the contact/filter modules and shield. Although not shown, vertical grooves may be formed in the rear side walls of the main housing for receiving rear wall 22, with dimples 29 serving to provide an interference fit with the side wall of the main housing and further secure the rear wall 22 thereto. Also shown in FIGS. 1 and 2 are mounting posts 30 extending from the bottom wall of the main dielectric housing member for insertion into openings in the circuit board on which the connector is mounted.

Shield 100 is preferably made up of a stamped and formed member which may be similar to the shield described in U.S. Pat. No. 5,775,946 (Briones), and which prior to assembly to the main dielectric housing 1 has been soldered to form a parallelepiped-shaped structure made up of a front panel 101, side panels 102 and 103, a top panel 104, and a rear panel 105, the rear panel being arranged to extend parallel to the top panel until the shield has been fitted over the housing, after which it is folded to cover the rear of the housing and secured by latching structures (not shown) to the housing or to the side panels of the shield. Extending from side panels 102 and 103 are grounding tabs 106 for insertion into apertures in the circuit board, and extending from the front panel adjacent openings 107 are grounding tabs 108 for engaging shields on the plug connectors to be inserted through apertures 109 in the front panel and into corresponding openings 4–11 in the main dielectric housing member 1. In addition, shield 100 may include optional external side grounding tabs 110, lower grounding tabs (not shown), rear grounding tabs (not shown), and/or top grounding tabs 111 for grounding the shield to a panel or other conductive structure depending on where the panel or other conductive structure is situated relative to the connector.

Modules 200 and 300 are similar in structure to each other but are oriented such that the contacts in module 200 extend downwardly and rearwardly into the corresponding upper openings 4–7 of the dielectric housing 1, and such that the contacts extend downwardly and rearwardly into the lower openings 8–11 of housing 1. The vertically mirror symmetric orientation of the contacts corresponds to the vertically mirror symmetric arrangement of notches 16 so that the upper openings receive connector plugs with the latching structure on the upper side of the plugs, and the lower openings receive the plugs oriented so that the latching structure is at the bottom of the plugs.

In order to implement the symmetric contact structure, modules 200 and 300 differ in the disposition of the slots that accommodate the contacts, in the surface to which the electrical filter and isolation components are mounted, and in the shape of the contacts, but otherwise are generally similar. Modules 200 and 300 each have generally L-shaped dielectric bodies 201,301 the horizontal portions 202,302 of which include molded in front contacts 203,2031. The mating ends 204,304 of the front contacts respectively extend upwardly and rearwardly at an acute angle, as is well-known, through slots 205 in a top surface 206 of horizontal portion 202 of module 200, and downwardly and rearwardly at an acute angle through slots 305 in a lower surface 306 of horizontal portion 302 of module 300. The opposite ends of four of the front contacts 203,2031, which have been bent into an L-shape or after before being molded into the horizontal main body sections 202,302 extend upwardly from surfaces 206,306 and include terminal structures 207,307 in the form of notched ends to facilitate winding of leads of filter components, in a manner similar to the terminals disclosed in copending U.S. patent application Ser. No. 08/866,107.

Figure 14:
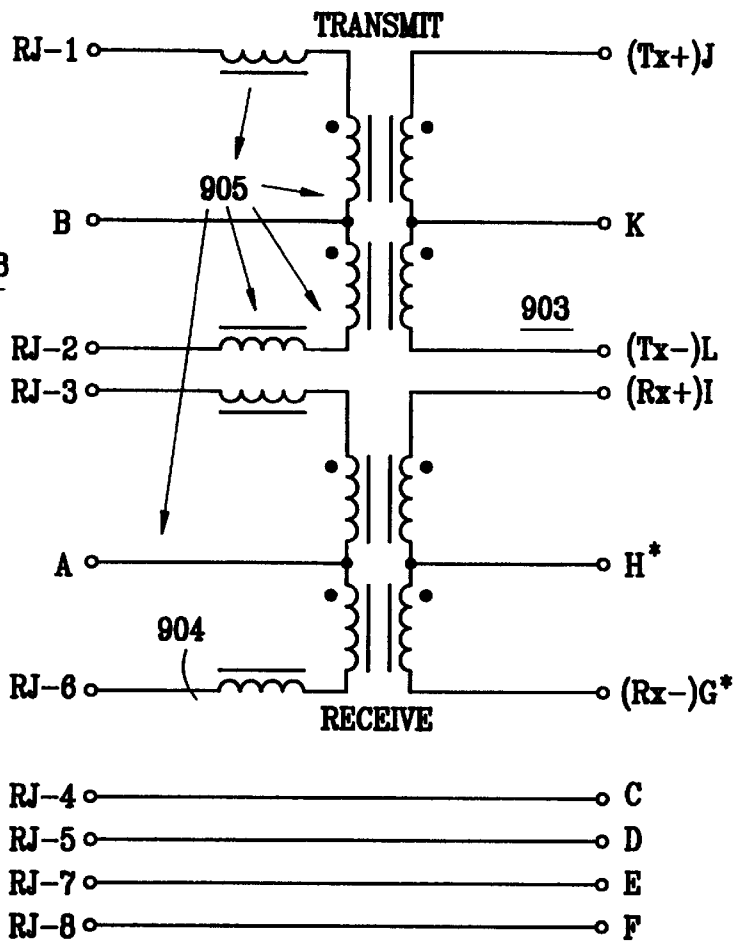
FIG. 14 is a schematic diagram of a variation of the circuit illustrated in FIG. 13.

The remaining four front contacts 2031 are arranged to form direct solderless connections to resistor chips to be described below. Advantageously, front contacts 2031 may be formed as dual contacts in which the angled portions 204,304 of a pair of contacts share a single horizontal rearwardly extending section in order to implement the connections illustrated in FIG. 13. In the alternative circuit of FIG. 14, none of the front contacts are paired and the resistors are omitted.

In addition to the front set of contacts, modules 200,300 are arranged to accommodate rear contacts 208,308. In module 200, the rear contacts 208 extend downwardly through passages 209 in vertical section 210 of the module main body 200. To facilitate positioning of the contacts in the passages, the contacts include lateral extensions 211 and passages 209 having corresponding enlarged openings 212 at their to. As illustrated, the upper sections 212 of the rear contacts forwardly at an oblique angle, and include vertical terminal structures 213 in the form of notched ends to facilitate connection to the filter components described below.

Figure 6:
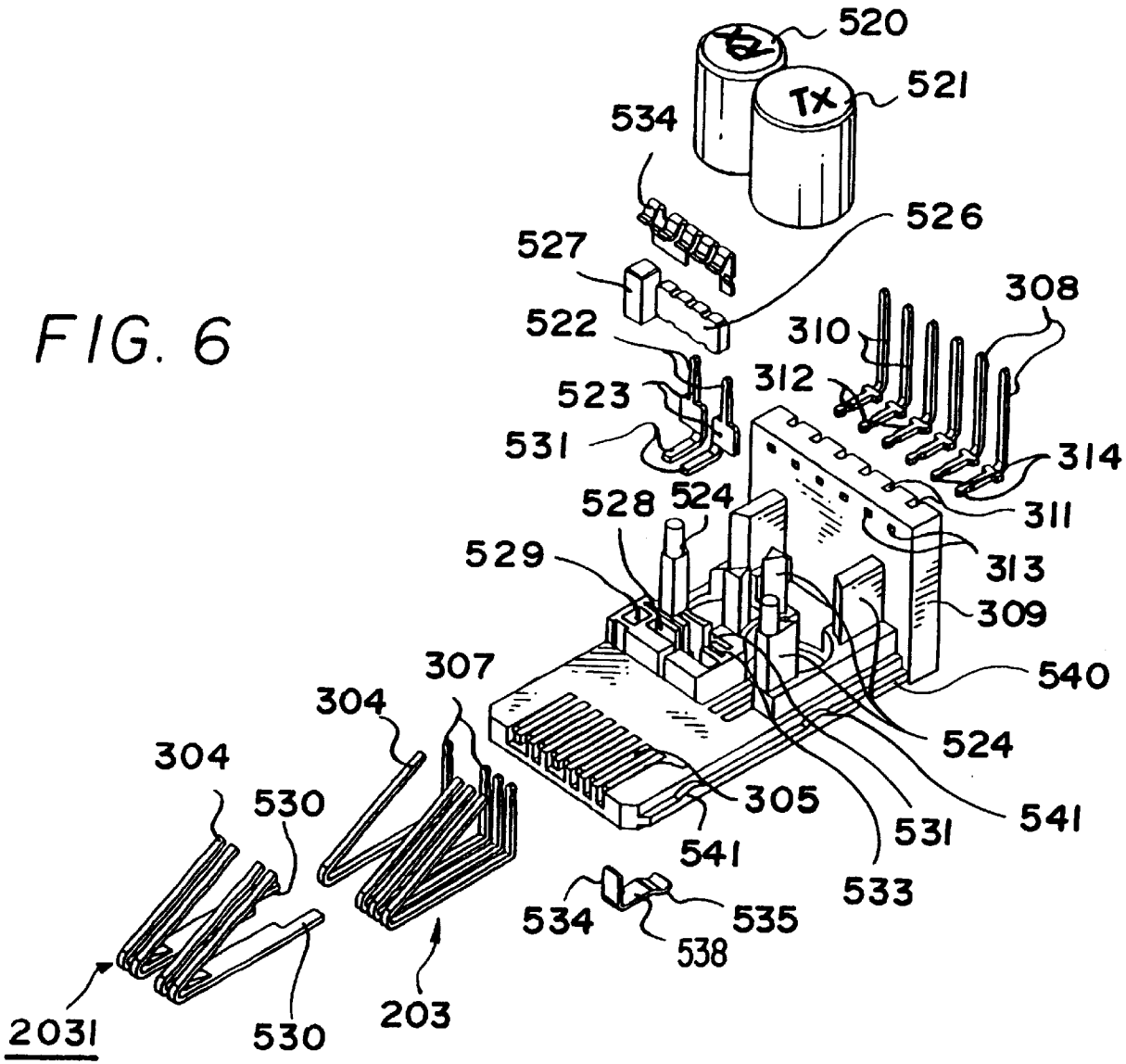
FIG. 6 is an isometric view showing the principal components of the contact/filter module illustrated in FIG. 5.
Figure 7:
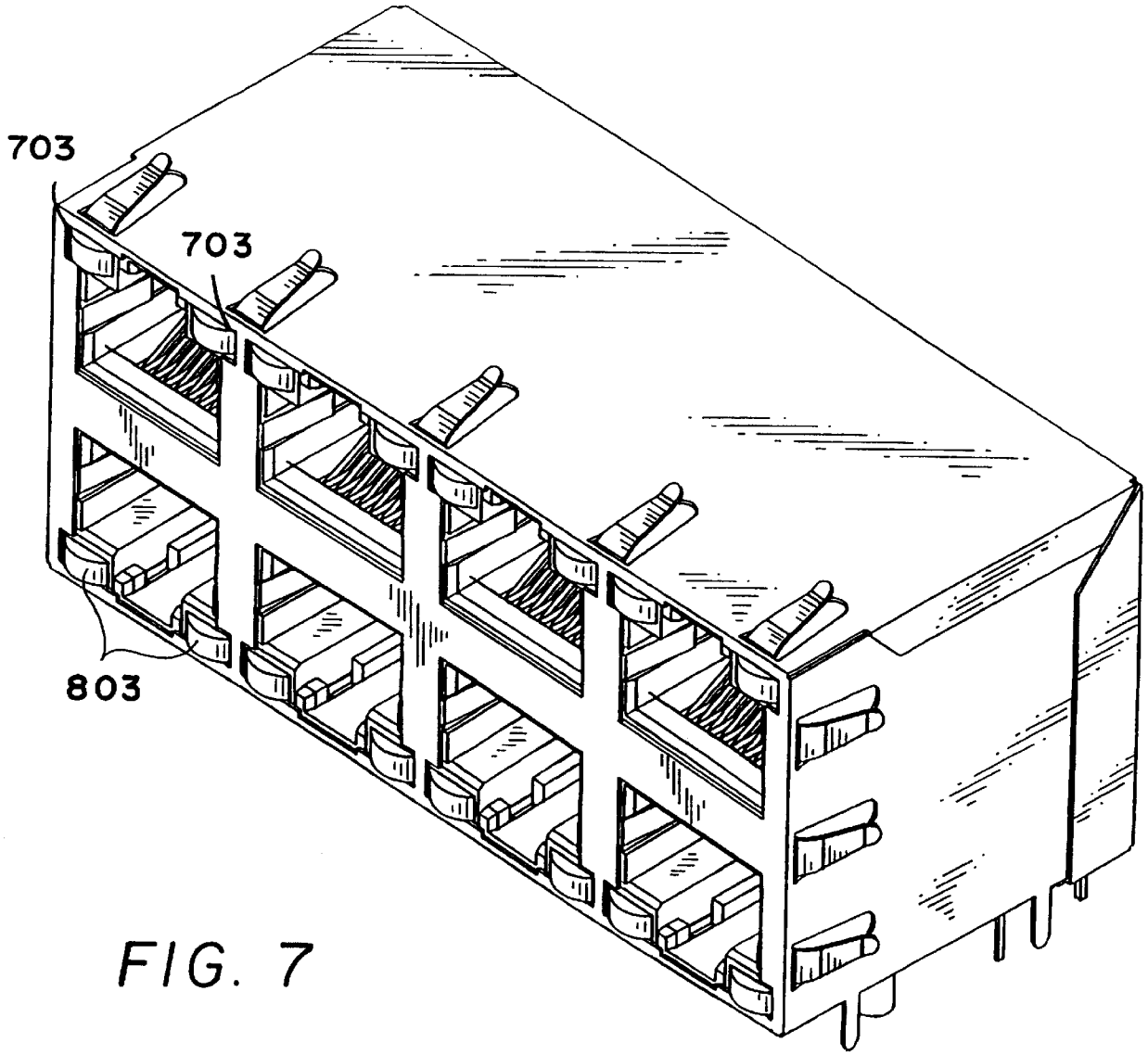
FIG. 7 is an isometric view of a multiport filter connector constructed in accordance with the principles of a second preferred embodiment of the invention.
Figure 8:
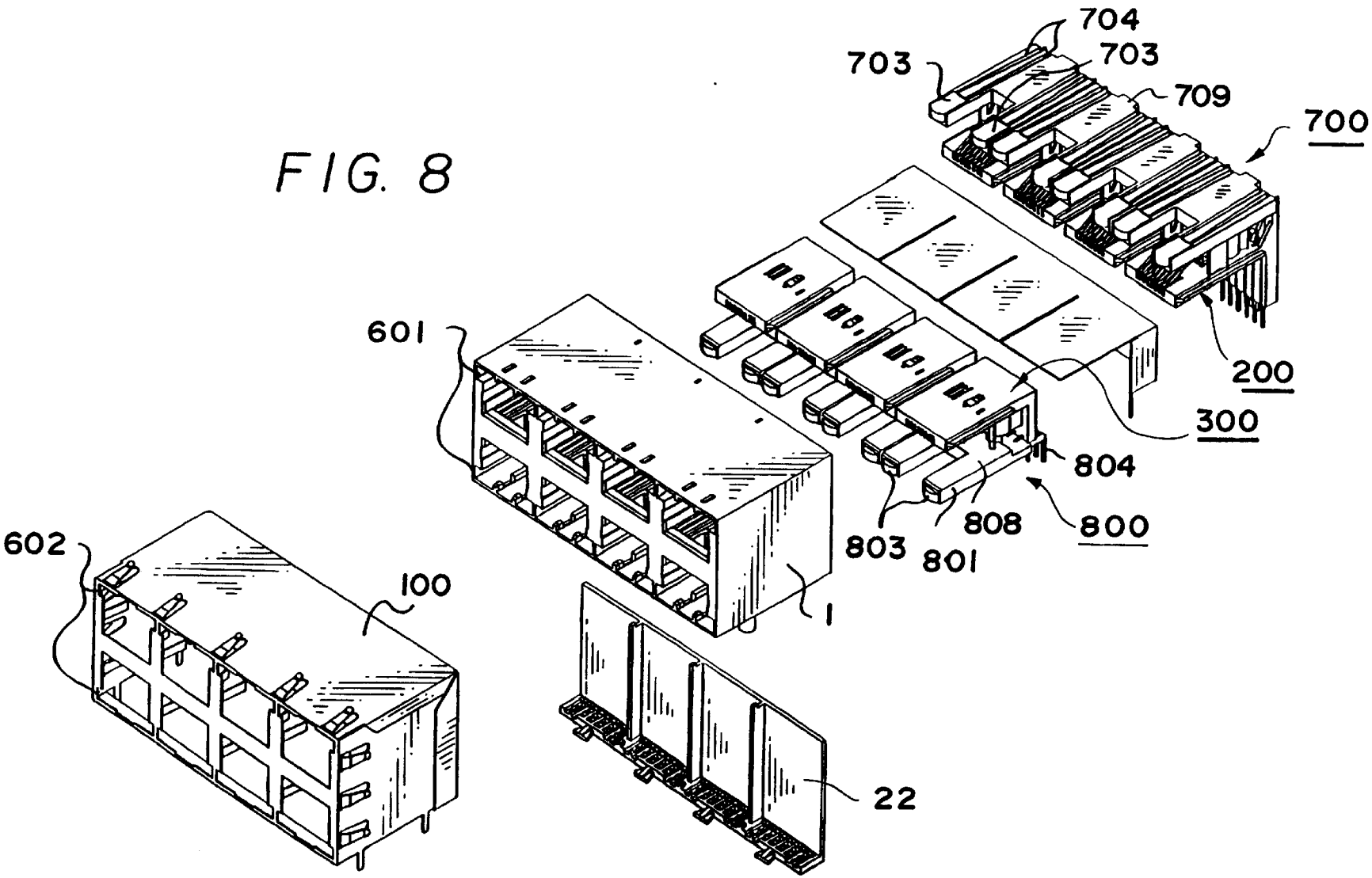
FIG. 8 is an isometric view showing the principal components of the multiport filter connector illustrated in FIG. 7.
Figure 9:
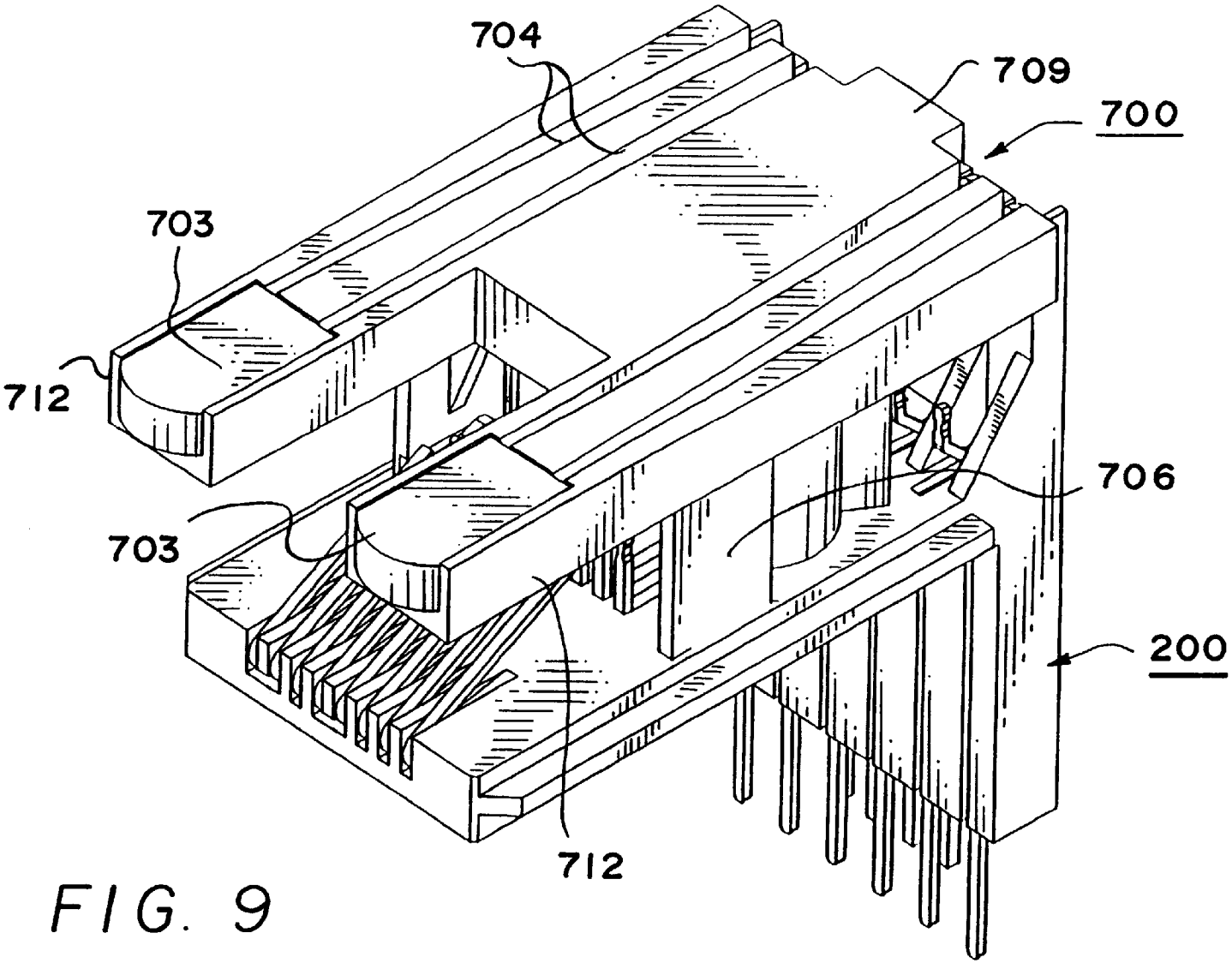
FIG. 9 is an isometric view of a first contact/filter module for use in the multiport filter connector of FIG. 7.
Figure 10:
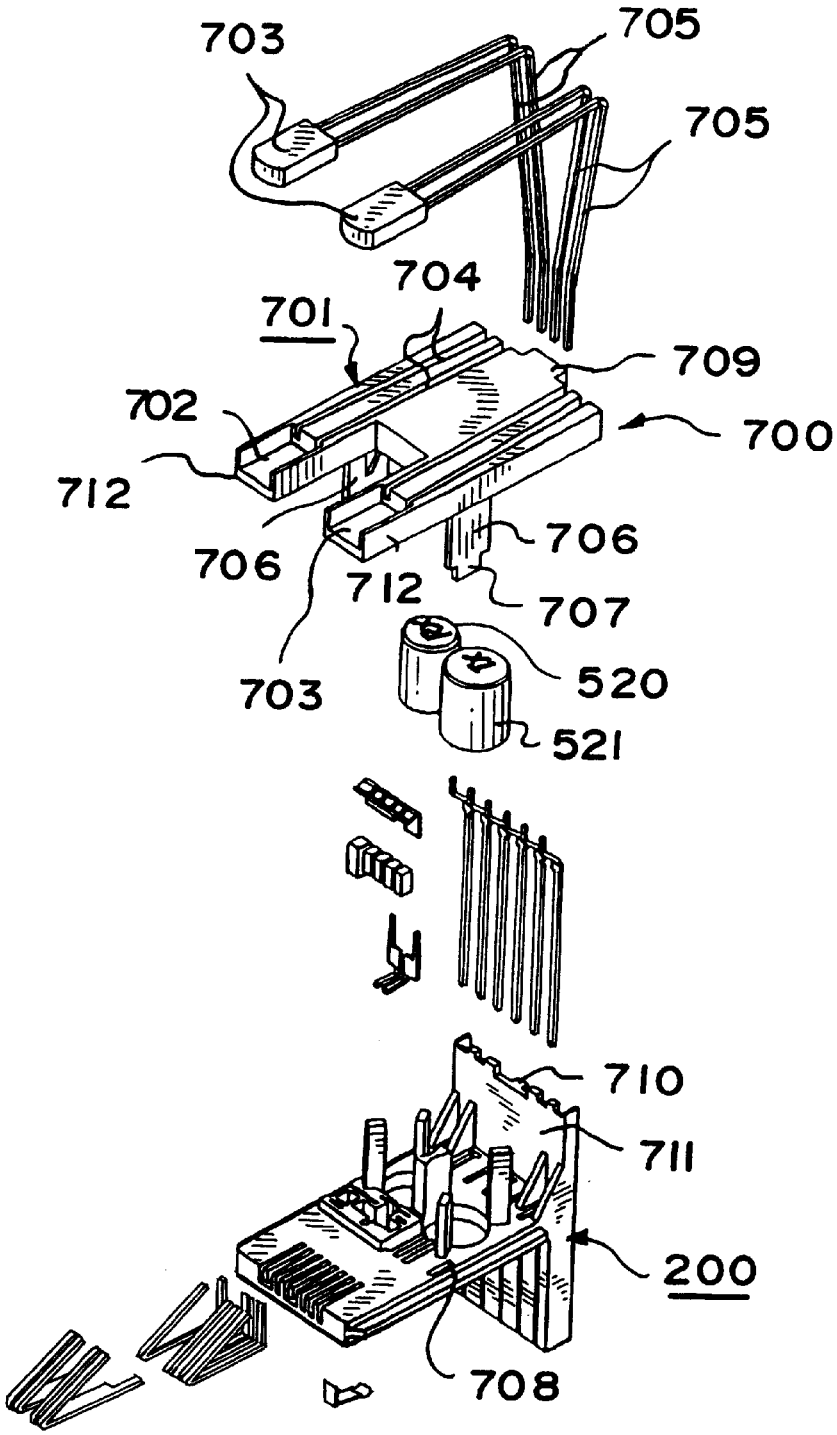
FIG. 10 is an isometric view showing the principal components of the contact/filter module illustrated in FIG. 9.
Figure 11:
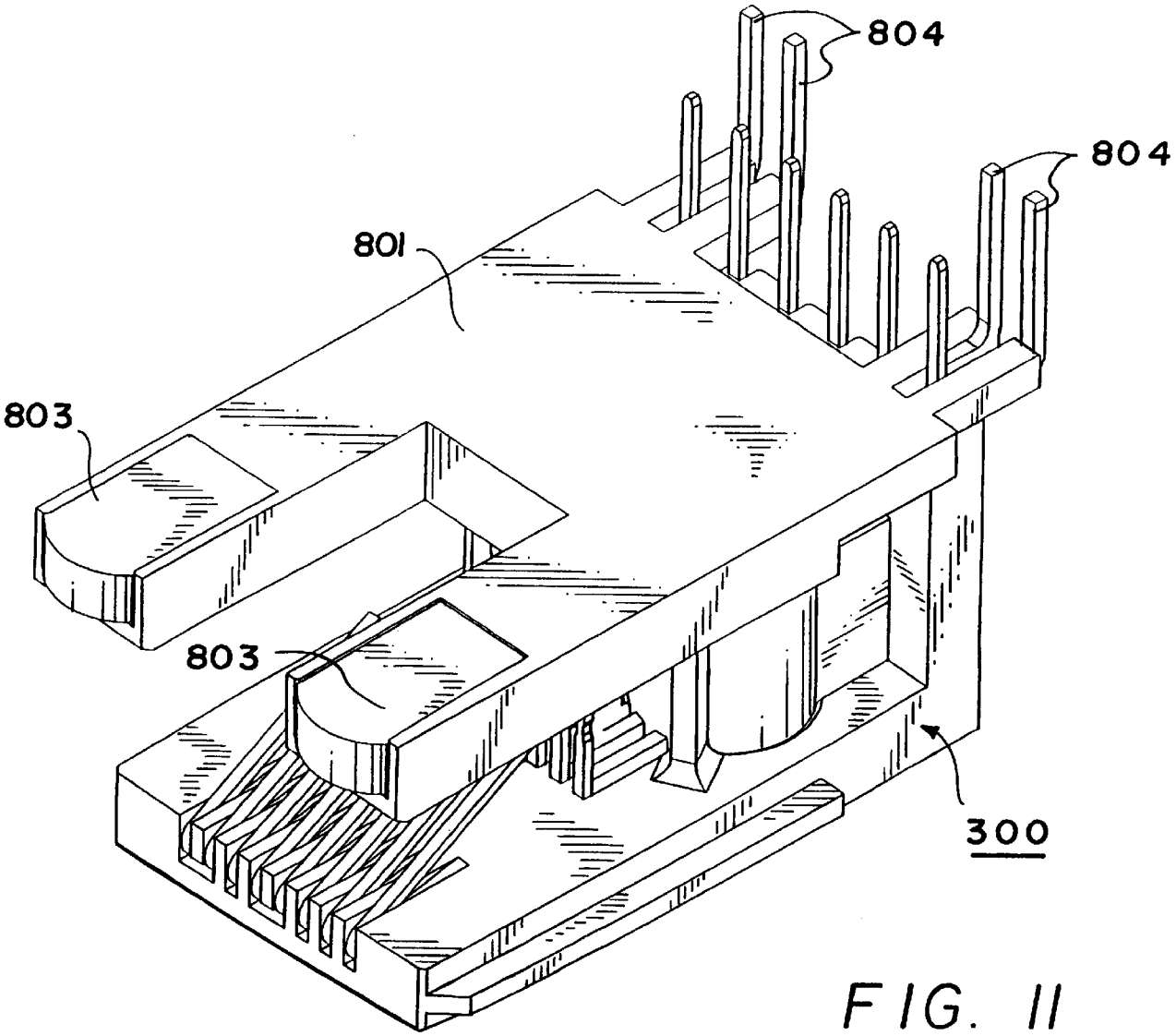
FIG. 11 is an isometric view of a second contact/filter module for use in the multiport filter connector of FIG. 7.
Figure 12:
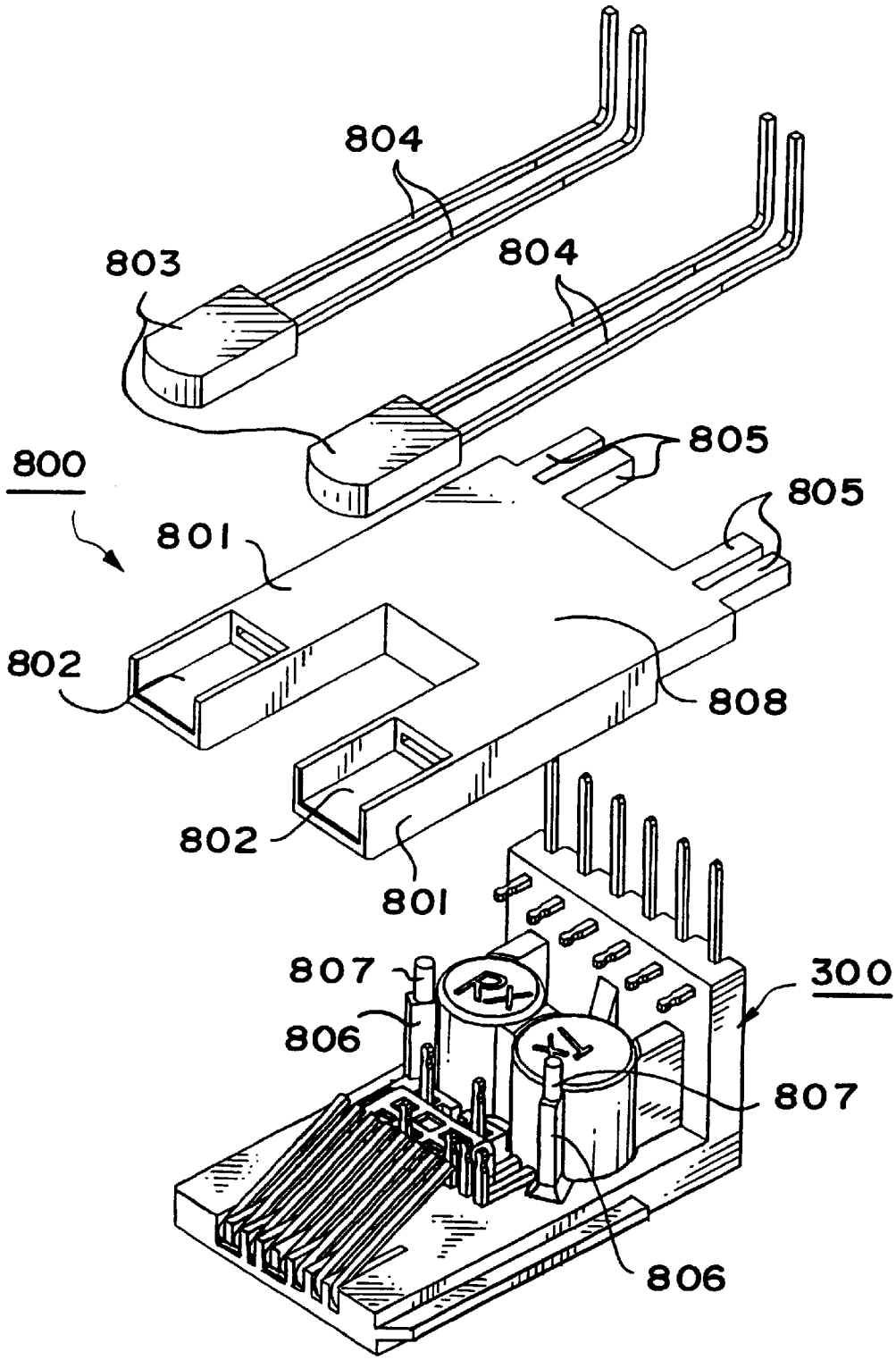
FIG. 12 is an isometric view showing the principal components of the contact/filter module illustrated in FIG. 11.

Because of the different orientation of modules 300, which are shown upside-down in FIG. 6, rear contacts 308 of module 300 are positioned at the bottom of vertical section 309. Rear contacts 308 include vertical sections 310 that extend vertically from grooves 311 and horizontal sections 312 that are molded into or extend through openings 313 in the vertical section and include notched terminal portions 314 to which leads of the filter components can be wound.

The remaining elements of the modules 200 and 300 are identical and therefore are given the same reference numbers. Preferably, the illustrated modules each include commonly packaged magnetic assemblies 520,521 including transformers and/or inductors having wire leads (one of which is schematically indicated by the dashed line labelled. 521L1 and a second of which is indicated by the dashed line labelled 522L2, the remaining wire leads having been omitted for clarity) extending from the packages and connected to terminal structures 207,307 and 211,312 of the respective front and rear contacts, as well as to terminal structures 522 of intermediate contacts 523. By way of example, each of the magnetic packages can include two cores corresponding to the inductors and transformers illustrated in the schematic of FIG. 13 (and which may be similar to those disclosed in U.S. patent application Ser. No. 866,107, herein incorporated by reference) or, alternatively, four cores each, or four packages with two cores each may be provided, and so forth, depending on the requirements of the filter and isolation circuits. In addition, the cores can be identical or constructed of different materials and configurations, and continuously wound, as disclosed for example in U.S. patent application Ser. No. 08/657,209, or separately wound, with or without additional taps. In any case, the magnetic packages are positioned by upwardly extending structures 524 whose configuration depends on the shape and dimensions of the magnetic packages in question, and which may include spindles for guiding wire leads extending from the magnetic packages to the terminal structures.

While the preferred embodiment of the invention could be implemented just using magnetic packages, according to an especially preferred aspect of the preferred embodiment of the invention, the contact/filter modules further include capacitor and resistor structures. As illustrated the resistors are in the form of a resistor chip 526 having a set of four upper electrodes and a set of four lower electrodes, and a capacitor chip 527 also having an upper electrode and a peripheral electrode. Resistor chip 526 and capacitor chip 527 are seated in slots 528 and 529 molded into respective horizontal sections 202 and 302 of modules 200 and 300. Extending into the bottom of slot 528 are two contact sections 530, which are integrally formed with the angled sections 204 of respective pairs of front contacts 2031, as described above, in order to implement the circuit shown in FIG. 13, and horizontal extensions 531 of the two intermediate contacts 523, with each of contact sections 530 and extensions 531 engaging one of the four bottom electrodes of resistor chip 526. Intermediate contacts 523 extend upwardly through slots 532, while between slots 528,529 and slot 531 is a slot 533 for accommodating a second intermediate contact structure 534 arranged to electrically connect four upper electrodes of resistor chip 526 with an upper electrode of the capacitor chip 527.

Figure 13:
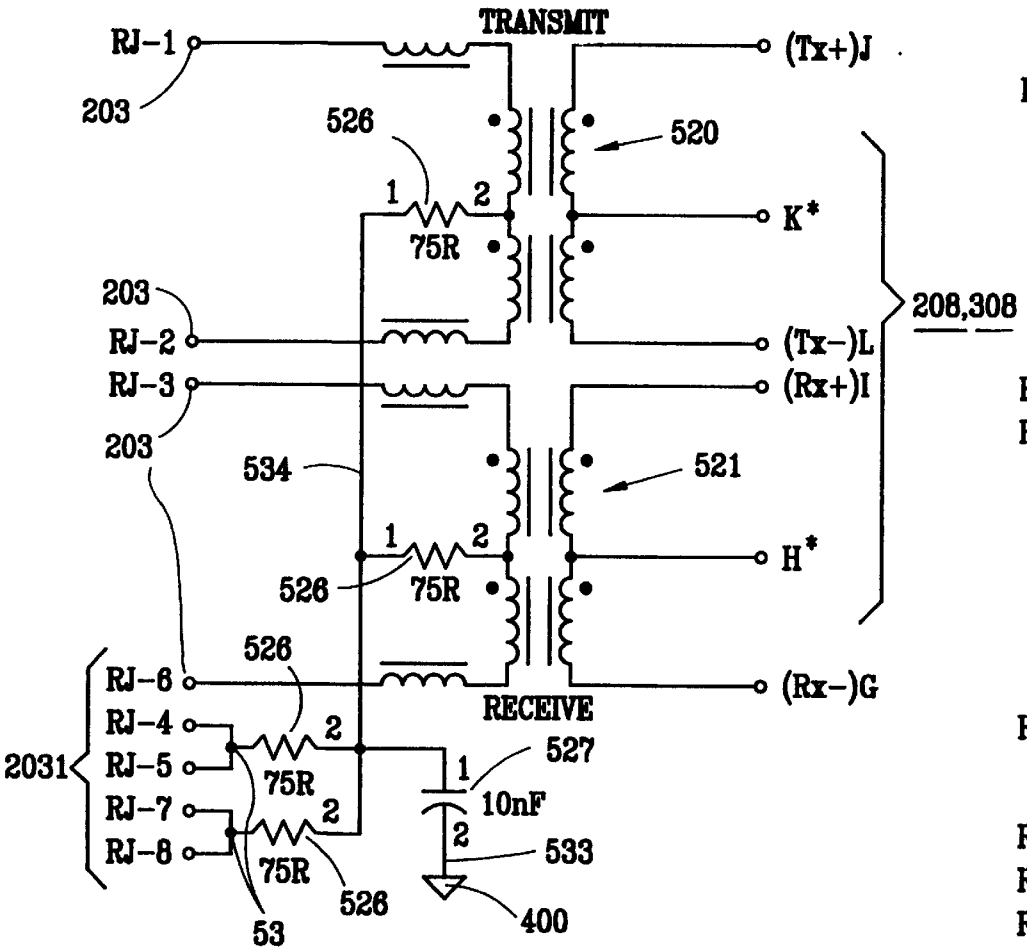
FIG. 13 is a schematic diagram of a circuit which can be arranged from the components illustrated in FIGS. 1–12.

As a result of this structure, dual front contacts 2031 are connected via two of the resistors formed by resistor chip 526 to the capacitor chip 527, and the magnetic packages 520,521 are connected via the remaining two resistors of resistor chip 526 to capacitor chip 527, thus implementing the circuit shown in FIG. 13.

In an especially advantageous aspect of this embodiment of the invention, the lower electrode of capacitor chip 527 is connected to ground via an L-shaped contact 538 extending into the slot 529 from below, and secured therein by barbs 534, contact 538 including a horizontal extension 535 with a dimple arranged to engage the internal ground plate structure 400 described below.

Finally, those skilled in the art will appreciate that the connections between the cores (not shown) provided within the magnetic packages 520 and 522 are not visible in FIGS. 3–6, but can easily be chosen to correspond to the connections illustrated schematically in FIG. 13. In addition, those skilled in the art will appreciate that the arrangement of the components and connecting contacts may be varied as necessary to implement different circuit configurations, such as the circuit illustrated in FIG. 14, which uses the same circuit components as the circuit illustrated in FIG. 13 (indicated by primed reference numerals), but in which the number of resistors within the resistor chip is increased (or additional resistors provided), and in which each of the front contacts is separately connected to the resistors or magnetic packages.

In order to position the modules 200 and 300 within respective slots or grooves 18 and 19 in the dielectric housing 1, each of the modules further includes a track 540 extending laterally from sides of the horizontal portions 202,302 and arranged to slide within slots or grooves 18 and 19 so that the modules can be inserted into the dielectric housing from the rear. As illustrated, the tracks 540 are provided with dimples 541 for providing an interference fit with slots or grooves 18 and 19 in order to secure the modules in the connector.

Assembly of the multiport connector of this embodiment of the invention is accomplished by first inserting tracks 540 of lower modules 300 into slots 18, and then inserting intermediate shield 400 into slots 20 and tracks 540 of upper modules 200 into slots 19 of the dielectric housing 1. The intermediate shield 400 is arranged such that partition walls 6 fit within slots 401 of the shield, slots 401 dividing the shield into panels 402 that extend between the upper and lower modules 200 and 300, thereby shielding the upper modules from the lower modules in order to prevent mutual interference or cross-talk between adjacent contacts in the upper and lower modules. If capacitor chip 527 or other grounded components are included on the modules, then contacts corresponding to contact 538 will engage the panels 402 upon assembly of the connector, connecting the component to ground via vertical extensions made up of rear panel 403 and side panels 404. Extending from side panels 404 are ground tails 405 for insertion into corresponding openings on the circuit board on which the connector is mounted, although those skilled in the art will appreciate that the shield could also be grounded to the external connector shield, which is also grounded to the circuit board via grounding tabs 108 described above.

The embodiment illustrated in FIGS. 7–12 is identical to that of FIGS. 1–6, except that LED sub-modules are further included. In order to accommodate the LEDs, the dielectric housing includes openings 600 corresponding to apertures 601 in the external shield, and the rear panel of the housing includes openings for the LED leads. Because the construction of the housing, shield, panels, and modules is otherwise identical to that of the embodiment shown in FIGS. 1–6, these elements are not described in detail in connection with FIGS. 7–12.

As in the first preferred embodiment of the invention, modules 200 and 300 are arranged to provide symmetrical contacts, and thus two different LED sub-modules 700 and 800 are required. The first sub-module 700, shown in detail in FIGS. 9 and 10, consists of a main body 701 having pockets 702 for accommodating LEDs 703, and grooves 704 extending rearwardly for accommodating the leads 705 of the LEDs. The grooves 704 are open at the rear so that the leads 705 can be bent vertically to extend behind the rear contacts down through openings in the rear panel into the circuit board. In order to facilitate mounting of sub-module 700 onto module 200, sub-module 700 is provided with posts 706 having tabs 707 at the end for insertion into slots 708 provided in module 200. Alternatively, sub-module 200 could be supported by posts extending upwardly from the sub-module and slots or holes in the horizontal section 706. In addition, at the rear of sub-module 700, as illustrated, is a tab 709 that fits within a slot 710 at the top of an upwardly extending vertical section 711 of module 200. Preferably, pockets 702 are provided in forwardly extending sections 712 that fit within openings 601 in dielectric housing 1 and openings 602 in the shield 400.

Sub-module 800 is similar to sub-module 700 and includes extensions 801 arranged to fit through openings 600 in dielectric housing 1 and openings 601 in shield 100, and which include pockets 802 for receiving LEDs 803. In this embodiment, the leads 804 of the LEDs extend along projections 805 and bent downwardly past the ends of the extensions. Support for the sub-module 800 is provided by mounting posts 806 having extensions 807 arranged to fit into holes (not shown) in the top of the sub-module main body 808.

Those skilled in the art will appreciate that the contact/filter modules illustrated in FIGS. 7–12 may be inserted into the dielectric housing 1 either with or without the LED modules, and that the multiport connector may include combinations of LED modules with modules that do not include LEDs, and modules without any filter or isolation components, or with different combinations of components.

Figure 15:
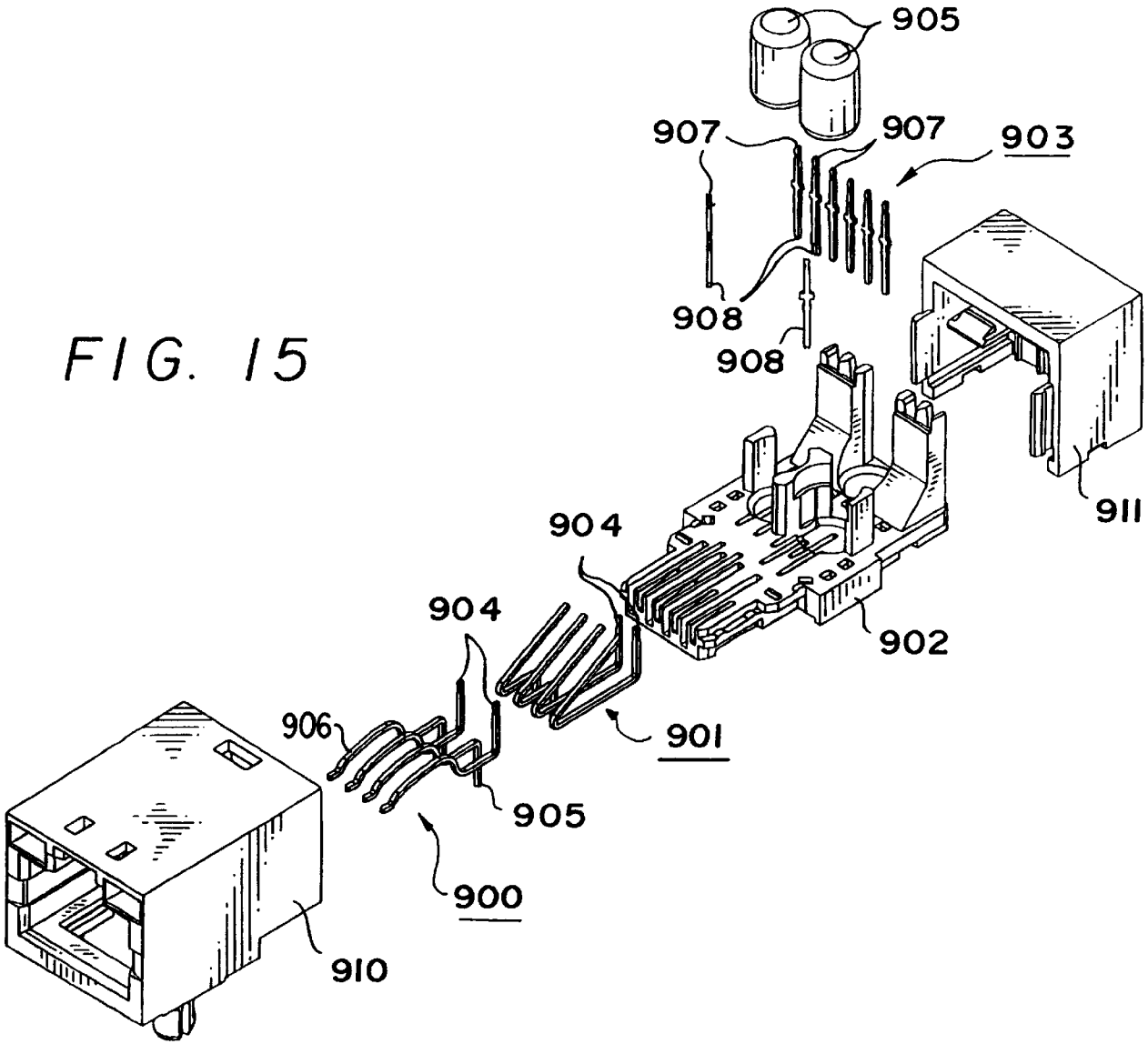
FIG. 15 is an exploded isometric view of a single port RJ connector which utilizes some of the principles of the preferred embodiment of the invention.

In addition, as illustrated in FIG. 15, any of the contact/filter modules described above may be adapted for use in a single port connector. In the embodiment of FIG. 15, the contact/filter module supports a plurality of lower front contacts 900 and a plurality of upper front contacts 901 positioned on a main body 902 that forms the base of the connector. Also positioned on main body 902 are a plurality of rear contacts 903. Some of contacts 900 and 901 have ends that are formed into terminals 904 to which leads of magnetic packages 905 are connected, for example according to the schematic illustrated in FIG. 14, and others of contacts 900 and 903 have ends that form contact tails 906. The opposite end of each of front contacts 900 and 901 are respectively formed into mating sections of the contacts, while rear contacts 903 all have at their upper ends terminals 907 to which leads of electrical components may be connected, and contact tails 908 at the lower ends. Finally, the contact/filter module thus formed is fitted into a main housing 910 to which a rear housing section 911 is secured in the manner described in U.S. patent application Ser. No. 08/866,107, which discloses the basic principles of providing an RJ connector base having front and rear contact sections, some of which have ends that are formed into terminals to which filtering and/or isolation components may be connected, and others of which are formed into contact tails. It will of course be appreciated that the main body 902 of this embodiment may include LEDs in a manner similar to that illustrated in FIGS. 7–12.

Having thus described preferred embodiments of the invention with sufficient particularity to enable those skilled in the art to easily make and use the invention, and having described several possible variations and modifications of the preferred embodiment, it should nevertheless be appreciated that still further variations and modifications of the invention are possible, and that all such variations and modifications should be considered to be within the scope of the invention. For example, while the upper and lower ports may be symmetrically arranged, it is also within the scope of the invention to arrange the upper and lower ports to have the same orientation. Furthermore, instead of grounding the intermediate shield directly to the circuit board, it could be grounded to the outer shield of the connector and, instead of mounting the cores on the base of the connector or on a spindle, the cores could be mounted on a printed circuit board within the connector, the general concept of using the connector itself to secure the cores could be extended to apply to filters other than the exemplary filter illustrated in the drawings, and other circuit elements could be added to the illustrated circuits. In addition, it is within the scope of the invention to replace the solderless connections between the various components on the contact/filter modules, including the solderless connection between the capacitor and the intermediate shield, with soldered connections.

Accordingly, the scope of the invention should not be limited by the above description, but rather should be interpreted solely in accordance with the appended claims.

We claim:

1. A multiport electrical connector, comprising:

a main electrical connector housing having a plurality of openings arranged to receive mating connectors, a plurality of contact pin modules to which are secured a plurality of mating contacts and a plurality of contact tails, each contact pin module being arranged in said housing such that portions of said mating contacts extend into an opening for mating with corresponding contacts on a mating connector, wherein said contact pin modules have arranged thereon a plurality of electrical components disposed on surfaces of the modules which are positioned horizontally in the connector, wherein an end of at least one of said mating contacts and at least one end of said contact tails form terminals between which are connected said plurality of electrical components, wherein said electrical components include a chip capacitor and at least one magnetic package, wherein said magnetic package contains at least one magnetic core, a transformer core and a choke core, and a first additional electrical contact structure mounted on said modules, one end of said first additional electrical contact structure engaging a first electrode on said chip capacitor and a second end of said first additional electrical contact structure forming a terminal to which leads of said magnetic package may be connected, and a second additional electrical contact structure having one end in engagement with a second electrode of said chip capacitor and a second end extending from said contact modules to engage a ground plate.

2. A multiport connector as claimed in claim 1, wherein said ground plate is an intermediate shield extending between said modules and a second contact module.

3. A multiport connector as claimed in claim 1, wherein said electrical components further include a resistor chip having a plurality of first electrodes on one side and a plurality of second electrodes on a second side, at least one of said plurality of second electrodes engaging an extension of one of said mating contacts, and at least one of said first electrodes engaging a portion of said first additional contact structure to thereby connect said chip capacitor and said magnetic package to said resistor chip, and through said resistor chip to said at least one of said mating contacts.

4. A multiport electrical connector, comprising:

a main electrical connector housing having a plurality of openings arranged to receive mating connectors, a plurality of contact pin modules to which are secured a plurality of mating contacts and a plurality of contact tails, each contact pin module being arranged in said housing such that portions of said mating contacts extend into an opening for mating with corresponding contacts on a mating connector, wherein said contact pin modules have arranged thereon a plurality of electrical components disposed on surfaces of the modules which are positioned horizontally in the connector, wherein an end of at least one of said mating contacts and at least one end of said contact tails form terminals between which are connected said plurality of electrical components, wherein said electrical components include a chip capacitor and at least one magnetic package, wherein said magnetic package contains at least one magnetic core, a transformer core and a choke core, and wherein said electrical components further include a resistor chip having a plurality of first electrodes on one side and a plurality of second electrodes on a second side, at least one of said plurality of second electrodes engaging an extension of one of said one of said mating contacts, and further comprising a first additional electrical contact structure mounted on said module, one end of said first additional electrical contact structure engaging a first electrode on said resistor chip and a second end of said first additional electrical contact structure forming a terminal to which leads of said magnetic package may be connected.

5. A multiport electrical connector, comprising:

a main electrical connector housing having a plurality of openings arranged to receive mating connectors, a plurality of contact pin modules to which are secured a plurality of mating contacts and a plurality of contact tails, each contact pin module being arranged in said housing such that portions of said mating contacts extend into an opening for mating with corresponding contacts on a mating connector, wherein said contact pin modules have arranged thereon a plurality of electrical components disposed on surfaces of the modules which are positioned horizontally in the connector, wherein an end of at least one of said mating contacts and at least one end of said contact tails form terminals between which are connected said plurality of electrical components, a shield plate extending between rows of said modules, and a first additional electrical contact structure mounted on said modules, one end of said first additional electrical contact structure engaging a first electrode on one of said electrical components, and a second additional electrical contact structure having one end in engagement with a second electrode of said chip capacitor and a second end extedning from said contact modules to provide a solderless connection to said shield plate when said modules and shield plate are inserted into said housing.

6. A multiport connector as claimed in claim 5, wherein said one of said electrical components is a chip capacitor.

7. A multiport electrical connector, comprising:

a main electrical connectorhousing having a plurality of openings arranged to receive mating connectors, a plurality of contact pin modules to which are secured a plurality of mating contacts and a plurality of contact tails, each contact pin module being arranged in said housing such that portions of said mating contacts extend into an opening for mating with corresponding contacts on a mating connector, wherein said contact pin modules have arranged thereon a plurality of electrical components disposed on surfaces of the modules which are positioned horizontally in the connector, wherein an end of at least one of said mating contacts and at least one end of said contact tails form terminals between which are connected said plurality of electrical components, and wherein one of said electrical components includes a plurality of first electrodes on one side and a plurality of second electrodes on a second side, at least one of said plurality of second electrodes engaging an extension of one of said mating contacts, and further comprising a first additional electrical contact structure mounted on said modules, one end of said first additional electrical contact structure engaging a first electrode on said one of said electrical components and a second end of said first additional electrical contact structure forming a terminal to which leads of another of said electrical components may be connected.

8. A multiport connector as claimed in claim 7, wherein said one of said electrical components includes at least one resistor.

9. A multiport connector as claimed in claim 7, wherein said extension of one of said mating contacts is formed integrally with said one of said mating contacts and also with a second of said mating contacts.

10. A contact/filter module for an RJ connector, comprising:

a plurality of mating contacts and a plurality of contact tails, said module being arranged to be inserted into a connector housing such that portions of said mating contacts extend into an opening in the housing for mating with corresponding contacts on a mating connector, a plurality of electrical components arranged on a surface of the module which is positioned horizontally in the connector, wherein an end of at least one of said mating contacts and at least one end of said contact tails form terminals between which are connected said plurality of electrical components, wherein said electrical components include a chip capacitor and at least one magnetic package, wherein said magnetic package contains at least one magnetic core, a transformer core and a choke core, and a first additional electrical contact structure mounted on said module, one end of said first additional electrical contact structure engaging a first electrode on said chip capacitor and a second end of said first additional electrical contact structure forming a terminal to which leads of said magnetic package may be connected, and a second additional electrical contact structure having one end in engagement with a second electrode of said chip capacitor and a second end extending from said contact module to engage a ground plate.

11. A contact/filter module for an RJ connector, comprising:

a plurality of mating contacts and a plurality of contact tails, said module being arranged to be inserted into a connector housing such that portions of said mating contacts extend into an opening in the housing for mating with corresponding contacts on a mating connector, a plurality of electrical components arranged on a surface of the module which is positioned horizontally in the connector, wherein an end of at least one of said mating contacts and at least one end of said contact tails form terminals between which are connected said plurality of electrical components, wherein said electrical components include a chip capacitor and at least one magnetic package, wherein said magnetic package contains at least one magnetic core, a transformer core and a choke core, and said electrical components further include a resistor chip having a plurality of first electrodes on one side and a plurality of second electrodes on a second side, at least one of said plurality of second electrodes on a second side, at least one of said plurality of second electrodes engaging an extension of one of said mating contacts, and further comprising a first additional electrical contact structure mounted on said module, one end of said first additional electrical contact structure engaging a first electrode on said resistor chip and a second end of said first additional electrical contact structure forming a terminal to which leads of said magnetic package may be connected.

12. A contact/filter module for an RJ connector, comprising:

a plurality of mating contacts and a plurality of contact tails, said module being arranged to be inserted into a connector housing such that portions of said mating contacts extend into an opening in the housing for mating with corresponding contacts on a mating connector, a plurality of electrical components arranged on a surface of the module which is positioned horizontally in the connector, wherein an end of at least one of said mating contacts and at least one end of said contact tails form terminals between which are connected said plurality of electrical components, wherein an said module include tracks arranged to fit within grooves in a connector housing in order to permit insertion and positioning of the modules within the housing, and a first additional electrical contact structure mounted on said module, one end of said first additional electrical contact structure engaging a first electrode on one of said electrical components, and a second additional electrical contact structure having one end in engagement with a second electrode of said chip capacitor and a second end extending from said contact module to provide a solderless connection to a shield plate when said module and shield plate are inserted into said housing.

13. A contact/filter module as claimed in claim 12, wherein said one of said electrical components is a chip capacitor.

14. A contact/filter module for an RJ connector, comprising:

a plurality of mating contacts and a plurality of contact tails, said module being arranged to be inserted into a connector housing such that portions of said mating contacts extend into an opening in the housing for mating with corresponding contacts on a mating connector, a plurality of electrical components arranged on a surface of the module which is positioned horizontally in the connector, wherein an end of at least one of said mating contacts and at least one end of said contact tails form terminals between which are connected said plurality of electrical components, and wherein one of said electrical components includes a plurality of first electrodes on one side and a plurality of second electrodes on a second side, at least one of said plurality of second electrodes engaging an extension of one of said mating contacts, and further comprising a first additional electrical contact structure mounted on said module, one end of said first additional electrical contact structure engaging a first electrode on said one of said electrical components and a second end of said first additional electrical contact structure forming a terminal to which leads of another of said electrical components may be connected.

15. A contact/filter module as claimed in claim 14, wherein said one of said electrical components in a resistor chip.

16. A contact/filter module as claimed in claim 14, wherein said extension of one of said mating contacts is formed integrally with said one of said mating contacts and also with a second of said mating contacts.

* * * * *